US006836284B2

(12) United States Patent
Murokh et al.

(10) Patent No.: US 6,836,284 B2
(45) Date of Patent: Dec. 28, 2004

(54) LASER MARKING USING A DIGITAL MICRO-MIRROR DEVICE

(75) Inventors: Igor Murokh, Santa Monica, CA (US); Alex Kerner, Pacific Palisades, CA (US); Sergey Filatov, Minsk (RU)

(73) Assignee: Tri-Star Technologies, El Segundo, CA (US)

( * ) Notice: Subject to any disclaimer, the term of this patent is extended or adjusted under 35 U.S.C. 154(b) by 2 days.

(21) Appl. No.: 10/623,693

(22) Filed: Jul. 18, 2003

(65) Prior Publication Data

US 2004/0196358 A1 Oct. 7, 2004

Related U.S. Application Data

(60) Provisional application No. 60/459,779, filed on Apr. 1, 2003.

(51) Int. Cl.[7] ..... B41J 2/47

(52) U.S. Cl. ..... 347/255; 347/239

(58) Field of Search ..... 347/239, 241, 347/244, 255, 256, 258; 250/201.9; 235/454; 359/298

(56) References Cited

U.S. PATENT DOCUMENTS

| | | | | |
|---|---|---|---|---|
| 4,595,647 | A | 6/1986 | Spanjer | 430/138 |
| 4,753,863 | A | 6/1988 | Spanjer | 430/138 |
| 4,769,310 | A | 9/1988 | Gugger et al. | 430/346 |
| 5,030,551 | A | 7/1991 | Herren et al. | 430/495.1 |
| 5,091,284 | A | 2/1992 | Bradfield | 430/292 |
| 5,111,523 | A | 5/1992 | Ferlier et al. | 385/100 |
| 5,206,280 | A | 4/1993 | Williams | 524/409 |
| 5,415,939 | A | 5/1995 | Yeung | 428/422 |
| 5,461,411 | A | 10/1995 | Florence et al. | 347/240 |
| 5,489,639 | A | 2/1996 | Faber et al. | 524/417 |
| 5,501,827 | A | 3/1996 | Deeney et al. | 264/460 |
| 5,697,390 | A | 12/1997 | Garrison et al. | 132/321 |
| 5,773,494 | A | 6/1998 | Gusi | 524/14 |
| 5,798,037 | A | 8/1998 | Peacock | 210/85 |
| 5,953,152 | A * | 9/1999 | Hewlett | 359/298 |
| 6,214,916 | B1 | 4/2001 | Merxc et al. | 524/404 |
| 6,295,153 | B1 | 9/2001 | Garner | 359/212 |
| 6,414,706 | B1 | 7/2002 | Allen et al. | 347/239 |
| 6,429,889 | B1 | 8/2002 | Murokh | 347/224 |
| 6,776,340 | B2 * | 8/2004 | Murokh et al. | 235/454 |
| 2003/0010889 | A1 * | 1/2003 | Igasaki et al. | 250/201.9 |

* cited by examiner

*Primary Examiner*—Hai Pham
(74) *Attorney, Agent, or Firm*—Bruce A. Jagger

(57) ABSTRACT

An object substrate that contains a markingly effective amount of a radiation sensitive marking material such as titanium dioxide is subjected to a patterned pulsed beam of coherent energy having a level of flux density that is at least sufficient to cause the radiation sensitive marking material to change color without degrading the object substrate. The pulsed beam of coherent energy derives its pattern from the instantaneous configuration of individual mirrors on the face of a digital mirror device (DMD) as the energy is reflected from that mirror face. The level of flux intensity at the mirror face is less than the level at which the DMD is at risk of damage or disruption. The level of flux intensity at the object substrate to be marked is sufficient to cause the titanium dioxide to change color, and substantially above the level at which the DMD is at substantial risk of damage or disruption. To accommodate these inconsistent requirements, the cross-section or footprint of a typical pulsed beam of coherent energy is expanded before and condensed after impinging on the mirror face of the DMD. Typically, pulses of coherent energy are serially generated in rapid succession, for example, by a laser, and each pulse possesses a level of flux density that is substantially above the level at which a DMD is at substantial risk of damage or disruption. This permits a DMD to be used to define instantaneously variable patterns or images with which object substrates are marked.

20 Claims, 3 Drawing Sheets

LASER MARKING USING A DIGITAL MICRO-MIRROR DEVICE

RELATED APPLICATION

The benefit of U.S. Provisional Application Ser. No. 60/459,779, filed Apr. 1, 2003, is claimed.

BACKGROUND OF THE INVENTION

1. Field of the Invention

The invention relates in general to the non-destructive pulsed laser marking of objects in a pattern defined by a digital micro-mirror device. The laser energy induces a color change in a radiation sensitive material that is contained in the object without damaging the object.

2. Description of the Prior Art

It is well recognized that ultraviolet and visible light lasers are suited to marking objects by reason of causing color changing reactions in a radiation sensitive material that is included within an object. The radiation sensitive material strongly absorbs the laser energy and undergoes a color change. Except for the energy absorbing material the object preferably absorbs very little of the laser energy. Infrared lasers generally tend to damage the objects because the energy is adsorbed and heats the object. Generally, infrared lasers are not used for non-destructive marking purposes. See, for example, Mercx et al., U.S. Pat. No. 6,214,916, and Faber et al. U.S. Pat. No. 5,489,639.

It is well recognized that pulsed UV lasers find application in the marking of titanium dioxide containing substrates. See, for example, Murokh U.S. Pat. No. 6,429,889 (consumable articles). See also, U.S. Pat. Nos. 5,501,827, 5,091,284, 5,415,939, 5,697,390, 5,111,523, 4,595,647, 4,753,863, 4,769,310, 5,030,551, 5,206,280, 5,773,494, and 5,798,037. Laser marking in the ultraviolet region causes a color change, typically, by photochemical reaction. It is customary to use masks of one description or another between the laser and the substrate to be marked. The mask serves to define the pattern of the coherent UV light that impinges upon the substrate, and, thus, the image that is recorded on the substrate. Alternatively, controlled beam deflection produces images one dot at a time, roughly comparable to a conventional dot matrix printer. See, for example, Faber et al. U.S. Pat. No. 5,489,639. Typically, the titanium dioxide in the substrate is white, and it turns black when coherent UV energy of at least a minimum flux density impinges on it in the pattern defined by the mask.

The use of pulsed laser energy to mark ceramics and glasses that contain radiation sensitive inorganic pigments is known. See, for example, Gugger et al. U.S. Pat. No. 4,769,310.

Pulsed lasers deliver very short but powerful bursts of energy. The duration of a typical pulse is from approximately 5 to 100 nanoseconds at as much as several megawatts of power. Many substances degrade at high levels of coherent UV or visible flux density if they absorb any significant amount of the coherent energy. Typically, titanium dioxide is present in a substrate material that is substantially UV transparent and does not absorb any significant amount of the UV energy. Titanium dioxide absorbs UV energy and undergoes a photochemical reaction so that it changes color from white to black. It is thus possible to mark titanium dioxide containing substrates with coherent UV energy without degrading the substrate to any visible degree. Other substrates are designed to absorb UV energy so as to prevent its reflection from the absorbing substrate.

The titanium dioxide in the UV transparent substrate changes color at a level of coherent UV flux density that is at or above the level at which the typical UV absorbing substrate degrades significantly. The use of pulsed coherent UV energy at a controlled flux density combined with titanium dioxide in a visible part of the object permits objects to be marked without causing visible physical degradation to the object. See particularly, Murokh U.S. Pat. No. 6,429,889. Where the marking is made visible by reason of the physical degradation of the object (as by ablation, melting or burning) high levels of flux density are employed, the coherent marking energy is generally supplied in the visible or infrared regions, and the substrate that suffers ablation absorbs the coherent energy.

The energy absorbing characteristics of natural and synthetic silicon and organic plastic materials are well known and need not be repeated here. Where coherent ultraviolet energy is employed to generate the desired marking, the substrate material from which the object to be marked is made should be selected so that does not absorb enough ultraviolet energy to cause ablation, thermochemical reaction, melting, vaporization, or other visible degradation.

Conventional laser marking systems generate the desired marking pattern using masks, linear marking, or dot matrix methods. The linear marking and dot matrix methods require careful coordination between the movement of the object to be marked and the laser beam. If the mask is moving so as to generate different patterns, the same careful coordination is required.

Digital micro-mirror devices (DMD) are well known. Typically, a digital micro-mirror device consists of an array of tiny mirrors (typically, several million per square inch), wherein the angular position of each mirror element is individually controllable between at least two positions that are angularly off from one another by approximately 10 to 20 degrees. A mirror base is located behind the mirror elements. The individually addressable mirror elements are tiltably mounted on mechanical hinges, and typically the array of mirror elements overlays a layer of controlling circuitry in the mirror base, all of which is mounted on a semiconductor chip. The mirror face of a DMD is composed of a generally rectangular grid array of the tiny rectangular mirror elements. A typical mirror element is about 16 micrometers square, and the individual elements are separated from one another by a distance of about 1 micron. Because of these separations, a portion of any energy that falls on the mirror face will bypass the mirror elements and fall on the mirror base. Individually controlled tilting of the mirror elements in the array around at least one axis allows energy that is reflected from the mirror face to be formed into a predetermined pattern. Further, the mirror face can be substantially instantaneously reconfigured responsive to digital signals to form a different pattern. Such reconfiguration generally requires approximately 25 microseconds. Digital micro-mirror devices have been proposed for use in high-resolution projectors. Proposals have been made to utilize these characteristics of a digital micro-mirror device in printing using generally continuous, visible, and non-coherent light. See, for example, Florence et al. U.S. Pat. No. 5,461,411, and Allen et al. U.S. Pat. No. 6,414,706. It has also been proposed to use a DMD to define a pattern of ultraviolet light on a substrate to catalyze a chemical reaction on the substrate in the pattern formed by the light. See Garner U.S. Pat. No. 6,295,153.

There are spaces between the adjacent edges of the individual mirror elements in the mirror array on the mirror face of a DMD so as to allow them the freedom to tilt independently responsive to commands by the control circuitry. Radiant energy that bypasses the individual mirror elements impinges on the base, including the controlling circuitry, hinges and supporting substrate below the mirror face. This bypass radiant energy should be absorbed, reflected away from the target substrate, or conducted elsewhere so that its random reflection does not blur the intended image that is reflected from the mirror face to the intended target. Absorption of the bypass energy causes an undesired build up of heat in the base. Also, particularly with coherent UV energy, the structure and circuitry below the mirror face tends to be damaged or disrupted by high levels of absorbed bypass radiant energy. There is a maximum acceptable level of absorbed bypass energy flux that can be tolerated by a DMD. Above this level, the DMD is at significant risk of failure.

The maximum level of coherent energy flux density that a DMD can tolerate is generally substantially below the minimum level of coherent energy flux density that is required to cause titanium dioxide or other radiation sensitive marking materials to change color. The level of flux density that is required to ablatively mark a substrate is generally several orders of magnitude greater than that required to cause radiation sensitive material in the target to change color.

The level of flux density of coherent energy is conventionally adjusted by expanding or condensing a beam of such energy to achieve a desired level of flux density. See, for example, Gatrner U.S. Pat. No. 6,295,153. Typical applications entail either expanding or contracting a beam of energy, but not both. There are practical limits to how much a beam of energy can be expanded and contracted. Uniformity of flux density across the cross-sectional area of the beam degrades with excessive expansion and contraction.

These and other difficulties of the prior art have been overcome according to the present invention.

BRIEF SUMMARY OF THE INVENTION

According to the present invention, an object substrate that contains a markingly effective amount of a radiation sensitive material, for example, titanium dioxide, in a visible portion thereof is subjected to a patterned pulsed beam of coherent energy, for example, UV laser energy, having a level of flux density that is at least sufficient to cause the radiation sensitive material to change color, but which is insufficient to cause visible physical degradation of the object substrate. The radiation sensitive material, the wavelength of the coherent energy, and the substrate material of the object are selected so that the radiation sensitive material strongly absorbs the coherent energy, and the substrate of the object does not. The pulsed beam of coherent energy derives its pattern from the configuration of individual mirrors on the face of a DMD as the energy is reflected from that mirror face. The pattern caused by the positioning of the individual mirror elements is instantaneously reconfigurable (within approximately 25 microseconds) responsive to digital signals received by the DMD. With pulsed coherent energy the mirrors are reconfigurable within the period between the pulses when the laser is not illuminated. The level of flux intensity at the mirror face is less than the level at which the DMD is at risk of damage or disruption. The level of flux intensity at the object substrate to be marked is sufficient to cause the titanium dioxide or other radiation sensitive material to change color, but below the level at which the object substrate is visibly degraded, and substantially above the level at which the DMD is at substantial risk of damage or disruption. To accommodate these inconsistent requirements, the cross-section or footprint of a typical pulsed beam of coherent energy is expanded before and condensed after impinging on the mirror face of the DMD. Better markings appear to be achieved if the beam of energy is generated with such a flux density that it requires expanding to protect the DMD from damage. Also, most suitable lasers produce pulses of energy that are above the threshold that typical DMDs can tolerate. Typically, pulses of coherent energy are serially generated, for example, by a laser, and each pulse possesses a level of flux density that is substantially above the level at which the DMD is at substantial risk of damage or disruption. Controlling the marking operation according to the present invention permits a DMD to be used to accomplish the marking of objects with substantially instantaneously variable patterns. Some wavelengths of energy are more degrading or disruptive to digital micro-mirror devices than others, depending upon the nature of the material from which the DMD is constructed and its configuration. Most such micro-mirror devices do not function well at temperatures above approximately 60 to 70 degrees centigrade. Infrared wavelengths generally quickly overheat the DMD. Visible wavelengths are more likely to cause overheating than UV wavelengths. With particularly sensitive marking materials the flux density of the visible light can be kept below that at which overheating occurs while still achieving a good mark. It is very difficult to protect the DMD from damage when the wavelength of the coherent energy is in the infrared range. The preferred wavelengths for the coherent light are in the UV range. The practical limits of expanding and contracting of the cross-sectional area or footprint of a pulsed beam of coherent UV energy are not exceeded where the marking occurs due to a change in the color of titanium dioxide or other radiation sensitive material in a visible part of the object substrate. By selecting the object substrate so that it absorbs little or no coherent energy relative to that absorbed by the marking material that is included within the substrate, it is possible to avoid visibly damaging the object substrate. The pigment particle size and loading rate are preferably optimized to achieve the desired detectable marking at the minimum level of coherent flux density. The DMD can be further protected if at least part of the bypass energy that falls between the individual mirror elements and onto the mirror base can be reflected or conducted away from the base. If this is not possible, then the flux density of the energy that impinges on the DMD must be kept below the level at which all of the bypass energy can be absorbed by the DMD without substantial risk of damage.

BRIEF DESCRIPTION OF THE DRAWINGS

The present invention provides its benefits across a broad spectrum of marking arts. While the description which follows hereinafter is meant to be representative of a number of such applications, it is not exhaustive. As those skilled in the art will recognize, the basic methods taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation.

DETAILED DESCRIPTION OF THE PREFERRED EMBODIMENTS

Figure 5:
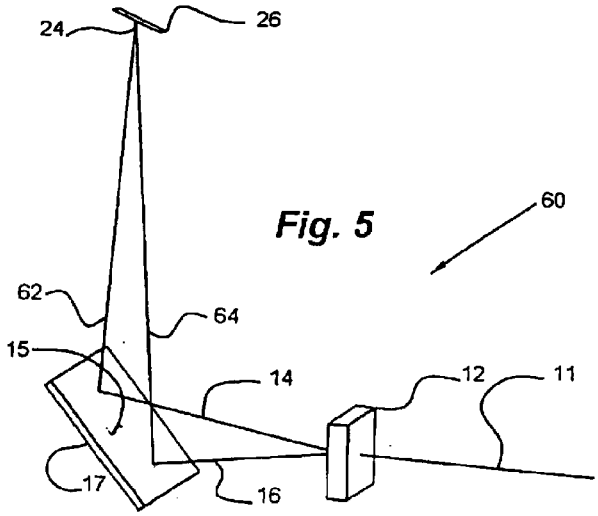
FIG. 5 is a partial diagrammatic view similar to FIG. 1 in which the condensing of the reflected beam is accomplished by the positioning of the individual mirror elements in the digital micro-mirror device.

Referring now to the drawings wherein like reference numerals designate identical or corresponding parts throughout the several views, there is illustrated generally at 10 a marking system wherein a coherent beam of pulsed ultraviolet energy 11 is generated by pulsed laser 13 and expanded optically by beam expander 12. Typically, pulsed lasers generate beams that have a high flux density, well beyond that which a digital micro-mirror device can tolerate without suffering physical degradation or disruption of its functioning. The use of beam expander 12 is thus necessary to reduce the flux density of the beam 11 to a level that the digital micro-mirror device can tolerate. The expanded beam of coherent UV energy, the boundaries of which are shown at 14 and 16, is projected onto the mirror face 15 of digital micro-mirror device 17. The individual elements in the mirror face 15 are positioned so that a portion of the incident UV energy is reflected in a predetermined pattern (see, for example, FIGS. 2 and 4). The boundaries of the reflected patterned beam are indicated at 18 and 20. The portion of the reflected beam that is not in the form of the desired pattern is reflected to and absorbed by a sacrificial target, not shown. The patterned reflected beam of coherent UV energy passes through an optical beam condenser 22, and is focused in target area 24 on object 26 (see particularly FIG. 4). Until it is condensed, the flux density in the reflected beam is insufficient to cause the titanium dioxide in object 26 to change color. Typically, object 26 is moved relative to the reflected patterned beam so that each pulse of laser 13 reaches a new target area 24 on the same or a different object 26. Preferably, object(s) 26 is kept in constant motion at a high enough rate to allow from 50 to 100, or more, different markings to be formed per second. That is, the rate of the movement of the object 26 is preferably fast enough to permit markings to be made at the rate at which the laser is pulsed. The positioning of the mirror elements in mirror face 15 is adjusted, if desired, before each pulse of coherent UV energy so as to form the desired pattern that is to be formed by the next pulse of energy. The optical condenser 22 can be eliminated, and the reflected patterned beam focused by the positioning of the individual mirror elements, if desired. See, for example, the marking system indicated generally at 60 in FIG. 5 wherein the edges of the mirror focused reflected beam are indicated at 62 and 64.

Figure 3:
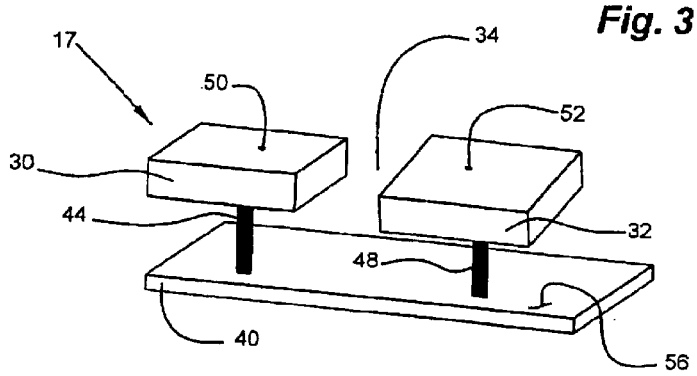
FIG. 3 is a partial diagrammatic perspective view of two individual micro-mirror elements, one of which is deflected out of the plane of the mirror face.
Figure 2:
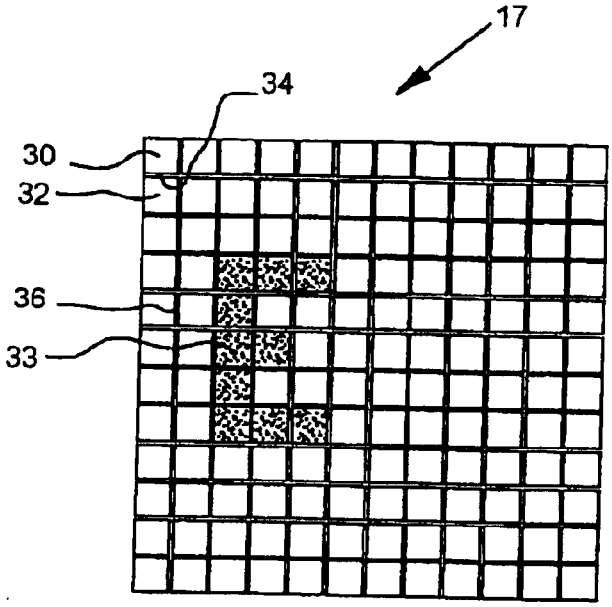
FIG. 2 is a diagrammatic plan view of the mirror face of a digital micro-mirror device showing a plurality of individual mirror elements, some of which are positioned in a predetermined pattern to reflect incident energy in form of the letter "E".

With particular reference to FIGS. 2 and 3, the mirror face of digital micro-mirror device 17 is populated with thousands of tiny, tiltable, individually controllable mirror elements, typical ones of which are indicated at 30 and 32. The mirror elements are separated from one another by spaces, typical ones of which are illustrated at 34 and 36. As shown particularly in FIG. 3, the individual mirror elements are tiltably mounted. The surface 50 of individual mirror element 30, and the surface 52 of individual mirror element 32 normally lie in about the same plane. By the application of a controlling force to effect the movement of, for example, support member 48, surface 52 can be tilted around at least one axis out of the common plane. If support 44 holds element 30 in its original position, Light incident on surface 50 will be reflected to a different location than light incident on surface 52. Energy that is incident on the mirror elements is reflected, however, energy that falls in space 34 reaches surface 56 of base 40. Allowing incident energy to be uncontrollably reflected from surface 56 would cause a loss in the sharpness of any pattern of energy that is reflected from the mirror face. Absorbing energy that is incident on surface 56 causes the build up of heat. Base 40 typically includes circuits and mechanical elements to effect and control the movement and positioning of the individual mirror elements. Excess heat tends to degrade, distort, and otherwise impair the functioning of the elements of the circuits as well as the mechanical elements. Also, where the energy is in the form of coherent ultraviolet energy that energy tends to break chemical bonds and ablate the material, and this tends to alter the physical characteristics of the mechanical elements.

Figure 4:
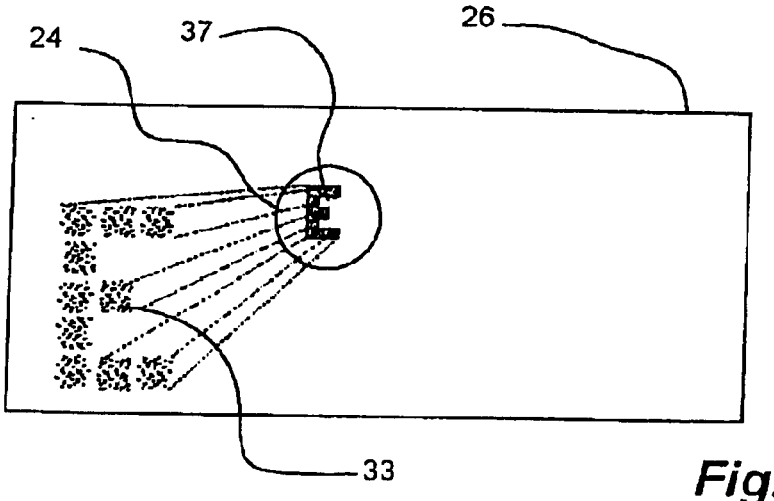
FIG. 4 is an enlarged plan view of a titanium dioxide containing object marked with an image, and showing by ray lines the condensation of the energy that forms the letter "E".

With particular reference to FIGS. 2 and 4, a number of individual mirror elements are controllably adjusted so that energy is reflected from the mirror face in a pattern such as the "E" 33. If the beam of energy reflected from the mirror face is not condensed it would appear as an energy shadow on the object that it is projected onto. This is shown, for example, at 33 in FIG. 4. This is not generally useful because the flux density of the energy in the uncondensed beam is generally not sufficient to cause a mark to appear on the object 26. Condensing the patterned beam of energy so that it is incident on the surface of object 26 in the marking zone 24 generates the "E" marking 37. The ray lines in FIG. 4 between "E" 33 and "E" 37 indicated the condensation of the beam. The footprint of the condensed beam on object 26 is such that the flux density of the beam at object 26 is sufficient to cause the titanium dioxide or other marking pigment in object 26 to change color.

Figure 6:
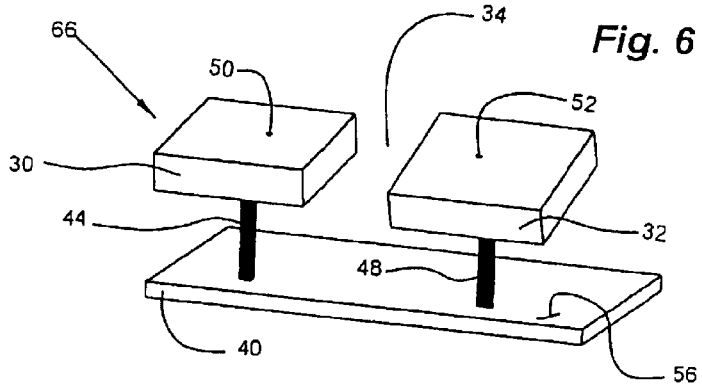
FIG. 6 is a partial diagrammatic perspective view of two individual micro-mirror elements similar to FIG. 3 except that the faces of the two mirror elements and the base to which the mirror elements is mounted are all in different planes so that incident coherent UV energy is reflected to three different targets.

Object 26 can be a series of separate objects to which one mark each is applied, or a continuous substrate upon which a series of separate markings, each in its own separate marking area are applied. Preferably, an entire bar code, word, design, or the like, is formed by one pulse so that any critical spacing of mark elements is controlled by the adjustment of the individual mirror elements in the mirror face rather than by any close synchronization between the movement of the object and the timing of the pulse. One discrete object, can, for example, be marked with a word, bar code, or the like, that requires several separate marks applied by several different marking pulses of energy to different marking areas on the object. Another identical discrete object is brought into the marking zone and the same pattern of images or marks is repeated. The mirror face is adjusted and the object is moved between each pulse so as to provide the desired series of marks separated from one another on the object. Alternatively, the same mark or series of marks can be repeated over and over on one continuous object at a series off different marking areas, as, for example, on a piece of wire, hose, or the like.

Where the bypass energy flux density is greater than what is preferred, reflecting or diverting some or all of the energy that bypasses the individual mirror elements reduces or eliminates the damage caused by absorbing the energy. The mirror array indicated generally at 66 in FIG. 6 diagrammatically illustrates the use of an energy reflecting face on the surface 56 of base 40. The surfaces 56, 50 and 52 all extend in different planes. Energy that is reflected from surface 56 is directed to a different target from that which falls on either of surfaces 50 or 52. The target for the reflected bypass energy can be at least partially within the digital micro-mirror device itself. Reflecting or diverting even part of the bypass energy reduces the risk of damage to the base 40 from the absorption of the remaining UV energy. Alternatively, the inclusion of, for example, wave guides for the UV energy (not shown) in base 40 allows some or all of the energy to be conducted away from the immediate location of the mirror elements and dissipated elsewhere. The digital micro-mirror devices are generally somewhat fragile and intricate. Any energy absorbing, reflecting and/or diverting elements in these devices must accommodate the structure and function that are required for the device to operate as designed.

Figure 1:
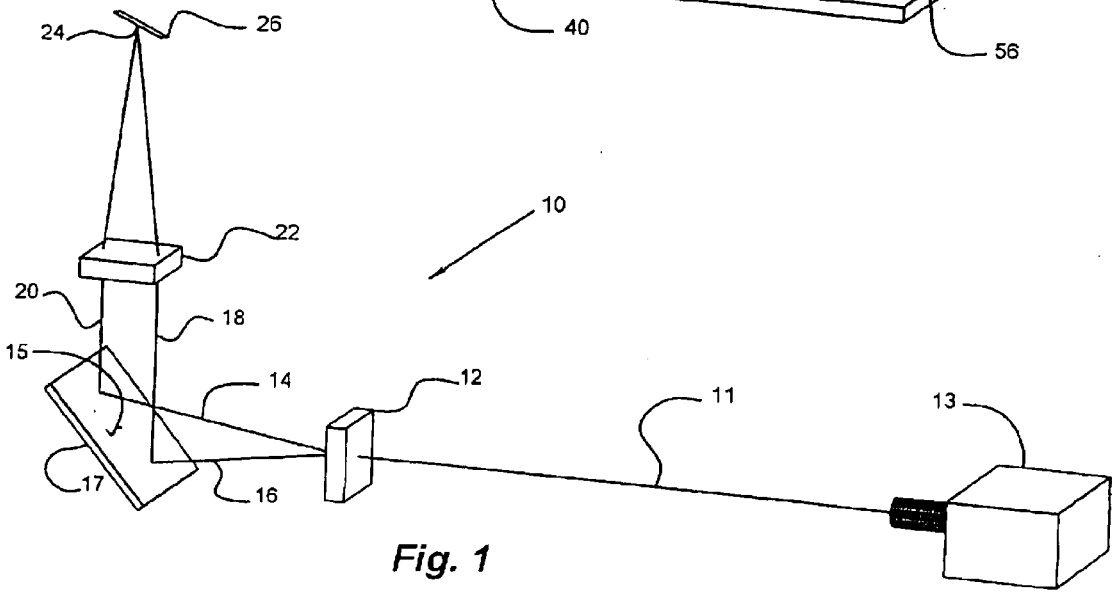
FIG. 1 is a diagrammatic perspective view of a preferred embodiment wherein a pulsed ultraviolet laser beam is expanded, reflected in a predetermined pattern from a digital micro-mirror device, condensed, and projected onto a titanium dioxide containing object.
Figure 7:
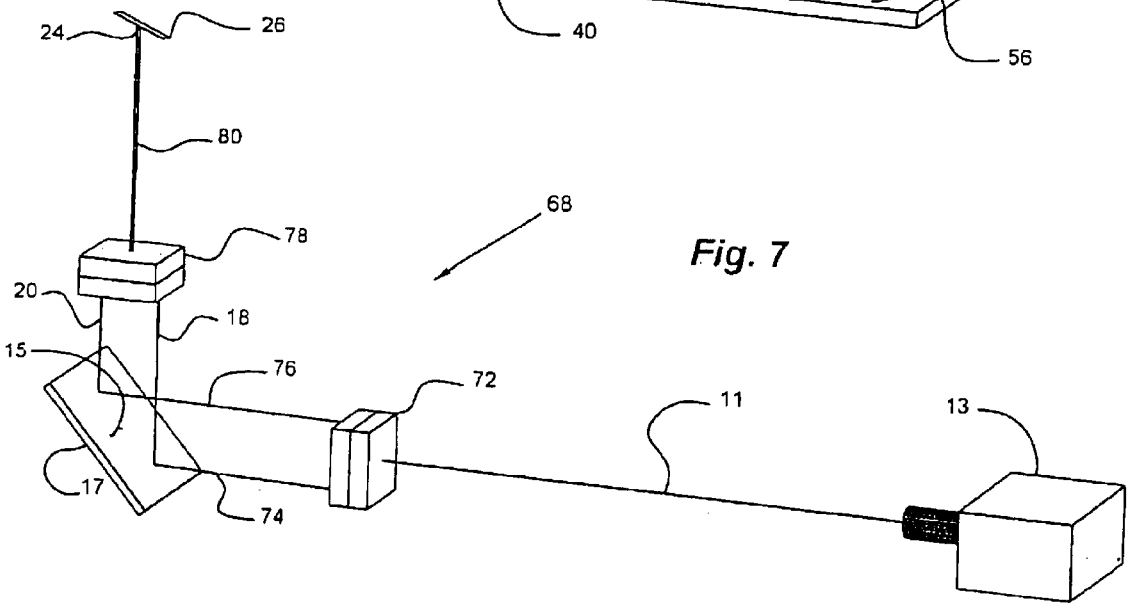
FIG. 7 is a diagrammatic perspective view of a preferred embodiment similar to FIGS. 1 and 5 wherein a pulsed ultraviolet laser beam is expanded to a generally parallel beam, reflected in a predetermined pattern from a digital micro-mirror device, condensed to a generally parallel beam, and projected onto a titanium dioxide containing object.

The embodiment of FIG. 7 is similar to that of FIG. 1 except that in the laser marking system indicated generally at 68, the beam 11 from the laser is expanded by expander 72 to a parallel beam indicated by edges 74 and 76, and condensed by condenser 78 to a parallel beam indicated at 80.

The limit of the flux density of the UV energy in the expanded footprint at the mirror face is determined by how much bypass energy the substrate or base to which the mirror elements are tiltably mounted can dissipate by reflection, absorption, conduction, or some combination thereof, without suffering damage. Reflection of the energy requires that the mirror base behind the individual mirror elements be provided with a UV reflective surface to reflect at least part of the energy to a target someplace out of the condensed marking footprint on the object to be marked. Preferably, a sacrificial target for such reflected bypass energy is provided, but an unused location on the object to be marked can be used in some applications. Absorption results in a heat build up as well as potential breakdown of the material of the absorbing substrate. Heat must be dissipated through heat exchange with the air or some solid structure. Conduction of the bypass energy away from the mirror base requires a coherent energy pipe such as, for example, a wave-guide. Regardless of how the bypass energy is dissipated, in general, the temperature of the mirror base should not exceed approximately 55 degrees centigrade. Higher temperatures tend to distort the mirror face and degrade the base and its function. For a pulsed ultraviolet laser with a duty cycle in the range of from approximately 5 to 50 nanoseconds, preferably approximately 10 to 20 nanoseconds, at approximately 25 to 500 hertz, preferably 50 to 400 hertz, the maximum permissible flux density (fluence) is generally from approximately 25 to 200 millijoules per square centimeter, and preferably between approximately 50 and 100 millijoules. The maximum allowable flux density for a given digital micro-mirror device in a particular marking operation is determined by observing the condition of the device over time. In general, the lowest practical level of flux density should be employed, and if the desired marking is achieved there is generally no need to increase it. The flux density values given here are primarily for guidance in determining the amount of expansion that the initial beam should undergo before falling on the mirror face. If, for practical reasons, a beam can not be expanded to a flux density below, for example, 300 millijoules per square centimeter, then generally some of the bypass energy should be reflected or diverted elsewhere so that the device is not harmed by absorbing it. At 50 to 100 millijoules per square centimeter the mirror base is usually capable of absorbing the energy, but dissipation of at least part of the bypass energy by reflection or conduction is often desirable.

Numerous pulsed lasers are available that can be operated in the ultraviolet region. Where high production rates in excess of 200 markings per second or more are required, ultraviolet excimer lasers, for example, can be used. Due to the very short pulse duration, objects can be marked on the fly, that is, while continuously moving at high rates of speed through the marking zone. The duration of the pulse relative to the velocity of the object is such that the object is essentially frozen in place for the duration of the pulse. The instantaneous position of the object does not change enough during the marking step to cause any perceptible blurring of the marking. Various object feed mechanisms can be used depending on the nature of the object. Marking at even very high rates of production, for example, 400 markings per second, can be achieved at high resolution and with little or no scrap rate. The configuration of the mirror face 15 can be adjusted electronically at a rate that is sufficient to accommodate such high rates of marking.

Marking is achieved when titanium dioxide or other radiation sensitive material absorbs coherent energy that is emitted in the visible or ultraviolet region, undergoes a photochemical change, and changes color. The amount of energy, for example, in the ultraviolet wavelengths, which is effective to cause, for example, the titanium dioxide to change color, is substantially completely absorbed by the titanium dioxide. Energy in other parts of the spectrum, for example, the infrared, would cause heating to a much greater depth and over a much wider area with the potential for damaging the object through physical degradation. Preferably, the ingredients in the marking layer, other than the titanium dioxide, are substantially transparent to the UV radiation. Also, to the extent possible the rest of the object should preferably be transparent to the radiation, although it can be, for example, reflective or conductive (for example, a wave guide) of the ultraviolet radiation.

In the preferred embodiment that has been selected for purposes of illustration only and not limitation, object substrates having a markingly effective amount of titanium dioxide in their outer surface layers, for example, about 2 percent by weight of the outer layer, provide satisfactory marking results when exposed to ultraviolet laser energy at, for example, a wavelength of approximately 355 nanometers, a pulse rate of at least about 20 Hertz, and a pulse duration of about 5 to 20 nanoseconds. A typical solid state UV laser, for example, generates per pulse about 50 millijoules, and has a beam diameter of about 5 millimeters. The pulse energy fluence is thus about 200 millijoules per square centimeter. In order to prevent damage to a typical DMD with a threshold of, for example, 50 millijoules per square centimeter the beam must be expanded to a diameter of at least about 10 millimeters. After the beam is projected onto and reflected from a digitally controlled mirror face, the beam must be condensed to about 3 square millimeters. This condensation produces a fluence of about 500 millijoules per square centimeter, which is generally sufficient to cause titanium dioxide to change color when exposed to one pulse of UV energy with a duration of approximately 10 nanoseconds. In general, the amount of titanium dioxide is preferably limited to that which is effective to produce the desired visible marking. Excess amounts serve no useful purpose, and can be detrimental. Preferably, the titanium dioxide need only be present in an effective amount in the layer of the objects where marking is to occur, but may be present throughout the entire volume of the object, if desired. The thickness of the layer that contains the effective amount of titanium dioxide need only be a few mills, if desired.

A Nd:YAG pulse laser, for example, is suitable for use according to the present invention. Such a laser is capable of being operated at 20 Hz, with marks being applied at a rate of about 1,200 per minute (720,000 per hour). It is to be appreciated that other lasers can be used, as desired, for purposes of increasing the marking rate. For example, an Xe:Cl excimer laser may be used, as desired, operating at up to as much as 400 Hz. Utilizing such a laser at 400 Hz provides the potential to mark objects at 24,000 per minute, (1,440,000 per hour). For example, the LPX 100i series Xe:Cl excimer laser, produced by Lambda Physik Inc., operating at 400 Hz and producing 100 millijoules of laser energy at a wavelength of 308 nanometers, could easily achieve the substantially increased marking rates discussed above. Other lasers may be used, as desired, such as solid state lasers (i.e. Nd:YAG, or Nd:YFL), or gaseous excimer lasers (XeCl, KrF, ArF, or F2), as long as the wavelength, energy density, and pulse duration, are effective to produce the desired marking.

The rate at which the target objects are moving in the marking zone is so slow, compared to the duration of the laser pulse, that the target objects are assumed to be stationary at the time of marking. Thus, the objects can be moving at a constant rate, or they can be accelerating or decelerating without having any significant impact on the quality of the marking. The efficiency of the system depends in significant part on the fact that the target objects can be marked while they are in motion and the pattern of marks can be changed between energy pulses. Preferably, the marking area of the target object is substantially perpendicular to the beam of energy, although misalignment of as much as, for example, 10 degrees, more or less, can be tolerated without rendering the marking unintelligible due to distortion. Even at greater angles the marking will still occur, but it may be so distorted that it is not easy to read. Since there is no physical impact required accomplish the desired marking, the target object need not be supported in any way. That is, it is free standing. Thus, it is feasible to mark an object while it is in free flight under the influence of gravity, after it has been discharged from a projecting device, or while it is under the influence of some transport agency.

According to the present invention, objects are marked by the application of radiation energy, and without the deposition of any ink or other external marking material, and without physically degrading the object. As used herein, a "non-deposited marking" is a marking in which no marking material, such as ink, paint or the like, is physically applied to an object during the marking process. Physical degradation results when the amount or nature of the energy applied to an object causes that object to burn, melt, vaporize, or otherwise degrade leaving a crater or an otherwise visibly damaged area that is readily visible with an optical microscope having a magnification factor of 5× or less. Such physical degradation can also include chemical degradation that undesirably alters the nature of the product. Chemical degradation is not necessarily visible. Conventional chemical or biological analysis can detect chemical degradation of an object. Chemical degradation occurs when the degradation is sufficient to materially impair the effectiveness of the object for its intended purpose. Trace degradation that has no material effect on the intended use of the object is not considered to be physical or chemical degradation.

The method of the present invention comprises selecting a radiation sensitive material that changes to a detectable color when exposed to a minimum flux of laser (coherent) energy, and incorporating an effective amount of that radiation sensitive material into a visible part of the objects that are to be marked. Generally, but not necessarily, the radiation sensitive material is in the outer or near outer layer of the object. The object(s) are then, for example, placed in motion and, preferably, a sensing location is established at a predetermined location or marking zone relative to a source of coherent ultraviolet energy. The sensing location detects the arrival of an object in the marking zone and triggers the firing of a laser. Alternatively, the laser can be moved relative to the object(s) and fired when it is in the proper position to mark an object, or both can be in motion when the laser is fired. The laser beam can be moved, without moving the laser, by the use of a suitable laser beam delivery system, if desired. Also, the firing of the laser can be synchronized to the movement of the object(s) relative to the laser by some means other than a sensor that detects the arrival of an object in the marking zone. For example, the mechanism can be synchronized so that the laser fires every time a particular station is passed by an object feed mechanism whether there is an object in position to be marked or not, or the like. Each of the objects is individually and instantaneously exposed to a predefined pattern of laser energy, preferably while it remains in motion. The laser energy is absorbed by the radiation sensitive material in each object according to a predefined pattern, and the material, for example, changes color to provide the required detectable marking. In general, the detectable marking is visible to the unaided human eye. The marking may, however, be such as to be detectable by alternative means such as exposure to ultraviolet light, examination by a microscope, machine readers such as bar code readers, and the like, if desired.

Precise positioning of the object relative to the source of laser energy, according to the present marking process, is not required. All that is required is that the area of an object that is to be marked be positioned within a relatively large focal range and roughly normal to a source of laser energy.

Because the marking results from the response to the laser energy of the radiation sensitive material present in the objects, objects can be marked even when fully encapsulated in energy transparent packaging materials, such as clear plastics. For instance, many objects are individually packaged. It has been found that laser marking of these packaged objects can be easily and effectively accomplished directly through their transparent packages. The layer in which the marking develops need not be the outer layer of the object so long as the layer(s) on top of the marked layer are transparent to the radiation and the marking detecting means. The marking actually occurs in situ at and below the surface of the pigment-containing layer. For the marking to be visible, the layer, and those above it, must be transparent enough to the visible spectrum of light that the marking is visible. The layer need not be fully transparent. If the marking is near the surface a colored layer that is opaque when its entire thickness is considered, the layer can still be sufficiently translucent for the marking to be clearly visible. Objects are often white in appearance because of the presence of the pigment, titanium dioxide. Where there is sufficient pigment to color the object white, the absorption of the ultraviolet energy and the resultant marking, takes place very close to the surface so that the markings are clear.

According to a preferred embodiment, an effective amount of finely divided pigment, such as titanium dioxide, is provided in the layer of the object that is to be marked. When exposed to a predefined pattern of laser energy in the ultraviolet range of from about 380 to 190 nanometers, precisely marked objects are produced with virtually no scrap. The markings are generally black. The markings are embedded in the layer so they are not entirely on the surface where they might be subject to erasure. They are generally visible by reason of a light colored background. Titanium dioxide is conventionally present in numerous objects. These objects can be marked with a laser according to the present invention without changing the formulation of the object. The titanium dioxide in these formulations was often intended to function as a whitening agent for the objects, and not at all for the purpose of enabling laser marking of the objects.

Generally, it is preferred that when the radiation sensitive marking material is titanium dioxide, it be comprised of the rutile crystalline form. Also, it is preferred that the titanium dioxide be substantially white.

The flux density of the coherent energy, for example, UV energy that is required to mark a particular object is dependent in significant part on the average particle sizes of the titanium dioxide or other pigment particles in the object. As the average particle diameter increases, more energy is required and the risk increases that energy will be dissipated by conventional heat and mass transfer processes beyond the pigment particles. For this reason, the average diameter of the particles should be minimized. The pigment particles should have average diameters of less than about 10 and preferably less than 5 microns. Particle sizes of less than approximately 2 microns average are preferred. Larger particles require the use of undesirably high flux energy pulses. Higher flux densities and longer pulses of energy risk physical degradation of the object and can, in extreme situations, slow the process down. The required maximum duration of the pulse increases approximately with the square of the particle diameter. The following formula can be used to approximately estimate the maximum duration of the pulse that can be tolerated before physical degradation occurs.

$$T=D^2\rho C_p/\lambda$$

where T=pulse duration in nanoseconds, D=particle diameter in meters, $C_p$=the heat capacity of, for example, titanium dioxide (690.37 Joules per kilogram degree Kelvin), $\lambda$=the thermal conductivity of titanium dioxide (6.55 Watts per meter degree Kelvin), and $\rho$=the particle density of titanium dioxide (4,000 kilograms per cubic meter). Read literally, this equation produces an answer in seconds. For ease of use this is converted to nanoseconds. Pulses of longer duration than those indicated by this equation will result in the application of more energy than the titanium dioxide or other pigment can absorb by itself. Pulses of shorter duration should be used to avoid damaging the target object. For a particle with an average diameter of about 0.5 microns the maximum pulse duration is approximately 100 nanoseconds. As will be understood by those skilled in the art, several approximations are made in the above equation which preclude relying on it to determine anything other than an approximate order of magnitude for the maximum pulse duration times. For example, round particles are assumed. This is, of course, a very rough approximation for most particles. A constant particle diameter across all particles in the target is assumed. Again, this is only an approximation. There will always be some particle size distribution and agglomeration. This formula is useful in arriving at the order of magnitude of the maximum allowable pulse duration from which those skilled in the art can easily optimize a particular system. Effective marking can generally be achieved using pulses that are significantly shorter than the maximum allowable length. For example, pulses of approximately 10 nanoseconds, an order of magnitude less, for example, than the maximum allowable duration, are generally effective in producing legible markings. The preferred pulse duration is from about 5 to 20 nanoseconds, but pulse durations of from approximately 5 to 200 nanoseconds are effective and can be employed, if desired. Some adjustment based on actual experimental results will generally be required to optimize the system. In general, the shortest pulse that is effective to produce a marking of the desired legibility should be used so as to minimize the risk of physically degrading the object.

The preferred applied flux density (in Joules per square centimeter) is proportional to the diameter of the pigment particle. Without wishing to be bound by any particular theory it is believed that it should be assumed that the absorbed pulse of energy should be sufficient to heat the average pigment particle in the target object to its melting point. The energy flux should be insufficient to change anything else in the target. Thus, where the pigment particles are the only part of the outer layers of the object that absorb ultraviolet energy, all of the energy should be absorbed by those particles. The following formula provides an approximation of the laser fluence (energy flux density) that is required.

$$F=2\rho C_p D(T_m-T_a)/3$$

Where F=the laser fluence (energy flux density) in Joules per square meter; $\rho$=the particle density (for $TiO_2$, 4,000 kilograms per cubic meter); $C_p$=the heat capacity of, for example, titanium dioxide (690.37 Joules per kilogram degree Kelvin); D=the diameter of the particle in meters; $T_m$=2116 degrees Kelvin, the melting point of titanium dioxide; $T_a$=the ambient temperature in degrees Kelvin. For ease of use the energy density is generally converted to Joules per square centimeter, and the particle diameter to microns. This equation establishes an energy threshold for a system where the pulse duration has already been established. This equation generally provides an approximation that tends to be in the middle to lower end of the acceptable range of energy flux. It provides an approximate benchmark from which those skilled in the art can easily optimize a particular system. In general an energy flux density of from approximately 10 to 0.1, preferably, 5 to 0.1 Joules per square centimeter is effective to form a satisfactory marking. Generally an energy flux density of from approximately 1 to 0.1 is most preferred. The minimum amount of energy that is effective to produce the desired marking should generally be used. For a particle with a diameter of about 0.5 microns the starting approximation for the laser fluence is in the order of 0.17 Joules per square centimeter.

The above equations yield the following calculated values for the titanium dioxide particle diameters that are indicated in Table I below.

TABLE I

| Particle Diameter-D (microns) | Energy Density-F (Joules/cm$^2$) | Maximum Pulse Duration-T (nanoseconds) |
|---|---|---|
| 0.10 | 0.03 | 4 |
| 0.25 | 0.09 | 25 |
| 0.35 | 0.12 | 49 |
| 0.50 | 0.17 | 100 |
| 0.75 | 0.26 | 225 |
| 1.0 | 0.34 | 400 |

The values given in Table I are order of magnitude values that provide those skilled in the art with a reliable starting point from which to optimize a particular system. Many different variables, not all of which are fully understood, enter into determining the optimum values for a particular system. For example, particle size distribution, the degree of pigment agglomeration that a particular processing system produces, and the like, all influence these values.

Energy density can generally be adjusted through a wide range to a predetermined level as may be desired. The pulse duration, by contrast, is generally a fixed characteristic of the laser. When a laser is selected for the purposes of this invention, this inherent characteristic should be kept in mind. Most generally available ultraviolet lasers have pulse durations of less than 100 nanoseconds.

The titanium dioxide or other pigment should be present in the layer that is to be marked in an amount ranging from approximately 0.5 to 5 weight percent, based on the weight of the layer. Preferably, the pigment is present in an amount of from about 1 to 3 weight percent. The optimum density of the ultraviolet radiation on the object generally depends in part on the concentration of the pigment. Increasing the concentration of the titanium dioxide or other pigment increases the risk of physical degradation. Below about 0.5 weight percent of pigment, the markings tend to become faint. As the concentration of the pigment increases the clarity of the marking improves up to a point where the particles are so close together that there is a risk of degradation by reason of the concentration of absorbed energy. Where the concentration is low, on average the energy is absorbed, and the marking occurs, deeper in the layer. The contrast is not as great where the concentration is so low that the marking occurs at a substantial depth in the layer. The pigment concentration should be minimized as much as possible to avoid the necessity of using high energy densities consistent with achieving markings of acceptable contrast and crispness. Where the quality of the marking is not what is desired even at the maximum safe energy levels, the solution is to increase the concentration of the pigment rather than to degrade the object by increasing the energy level. Above a certain pigment concentration, however, the amount of energy required to generate an acceptable marking increases to an unacceptable level where degradation of the object is likely to occur. In general, pigment concentrations of less than approximately 5 weight percent are acceptable. It is assumed that the pigment particles are all of approximately of the same size and are equally distributed in the layer that absorbs the energy. Some processing procedures do not provide such optimum uniform distribution. Such systems should be optimized for the particular size and bulk distribution according to the teachings of the present invention.

The optimal wavelength for the coherent energy is that at which the titanium dioxide or other pigment absorbs energy most strongly. This is below about 400 nanometers for titanium dioxide. In general, lasers that emit ultraviolet light in the range of from about 380 to 190 nanometers are useful, with those that emit energy at about 360 to 240 nanometers being preferred for titanium dioxide.

Titanium dioxide is the generally preferred radiation sensitive marking material, because it is generally regarded as safe by the United States Food and Drug Administration. Its presence in products and its use in production do not pose safety concerns. Also, it is readily available, inexpensive, and strongly absorbs UV energy and changes color from white to gray or black, so the markings are easily visible. It permits marking with minimum flux density, particularly when particle size and concentration are optimized for minimum activation energy. Such optimization permits the flux density of the energy beam at the face of the digital micro-mirror device to be well below the level that the DMD can tolerate without risk of failing. Other radiation sensitive pigments that are suitable for marking with pulsed laser energy include, for example, organic and inorganic pigments such as tin oxide, iron oxide, zirconium oxide, zirconium vanadium yellow, preseodyme yellow, zirconium vanadium blue, zinc-iron-chrome spinels, zirconium iron pink, titanates such as nickel-antimony titanate, chrome-antimony titanate, manganese-antimony titanate, cadmium sulfides, cadmium sulfoselenides, cobalt aluminates, chrome tin pink sphene, chrome tin orchid cassiterite, copper red, maganese pink, colcothar, iron-chrome-alumina spinels, manganese-alumina spinels, zinc-chrome spinels, iron-alumina spinels, zinc-iron spinels, nickel-iron spinels, manganese-chrome spinels, and the like. Various conventional organic pigments are also suitable for use according to the present invention. The absorption characteristics of conventional organic and inorganic pigments are well known. These materials generally change color when they absorb pulsed coherent energy of sufficient flux density. Different pigments absorb energy most strongly at different wavelengths. The pigment and the wavelength of the laser are matched to one another so that the pigment strongly absorbs energy at the wavelength of the coherent energy that is emitted by the laser. The substrate of the object in which the pigment is incorporated (generally the pigment is mixed with and substantially uniformly distributed throughout at least the visible layer or part of the object substrate where the marking is to be applied) is selected so that it absorbs much less of the incident coherent energy than the pigment. Preferably, the substrate of the object absorbs approximately 5 to 10 times less incident coherent energy than the pigment. Preferably, the substrate of the object is substantially transparent to the wavelength of coherent energy that the pigment absorbs. The color of the mark is generally dependent on the selection of pigment. For example, zirconium-iron pink changes from pink to beige, cadmium yellow changes from yellow to brown, cadmium red changes from red to gray; chromium oxide changes from green to brown, and the like. Organic pigments tend to bleach to lighter colors when subjected to coherent energy.

The properties of various generally available and widely used inorganic pigments are set forth in the following Tables 2 through 4. These pigments all change color when subjected to pulsed laser energy. Titanium dioxide is included in these Tables for purposes of reference. The threshold activation energy for the color change (laser fluence) is approximately the same for all of these pigments. While not wishing to be bound by any theory, it is believed this indicates that similar photochemical processes induce the color change. The differences in pulse duration appear to be due to the different thermal properties of the materials, primarily the thermal conductivity. As conductivity increases, pulse duration should decrease so as to dissipate heat in the color change reaction rather than by conduction in the substrate.

TABLE 2

Physical Properties of Various Inorganic Pigments

| Material | Chemical Formula | Density, ρ (kg/m$^3$) | Melting Point, T (K) | Heat Capacity, $C_\rho$ (J/kg K) | Thermal Conductivity, λ (W/m K) |
|---|---|---|---|---|---|
| Titanium Dioxide | $TiO_2$ | 4000 | 2116 | 690 | 6.55 |
| Tin Oxide | $SnO_2$ | 6950 | 1898 | 343 | 31.4 |
| Zinc Oxide | ZnO | 5600 | 2248 | 493 | 27.2 |
| Magnetite | $Fe_3O_4$ | 5200 | 1867 | 652.7 | 5 |
| Zircon | $ZrO_2SiO_2$ | 4600 | 2473 | 543.9 | 4.2 |

TABLE 3

The Effect Of Particle Size On The Threshold Laser Fluence Required To Cause Marking

| Particle | Laser Fluence (Joules/cm$^2$) | | | | |
|---|---|---|---|---|---|
| D (microns) | $TiO_2$ | $SnO_2$ | ZnO | $Fe_3O_4$ | $ZrO_2SiO_2$ |
| 0.1 | 0.03 | 0.03 | 0.04 | 0.04 | 0.04 |
| 0.25 | 0.08 | 0.06 | 0.09 | 0.09 | 0.09 |
| 0.35 | 0.12 | 0.09 | 0.13 | 0.12 | 0.13 |
| 0.5 | 0.17 | 0.13 | 0.18 | 0.18 | 0.18 |
| 0.75 | 0.25 | 0.19 | 0.27 | 0.27 | 0.27 |
| 1 | 0.33 | 0.25 | 0.36 | 0.36 | 0.36 |

TABLE 4

The Effect Of Particle Size On The Laser Pulse Duration Required To Cause Marking

| Particle | Laser Pulse Duration (nanoseconds) | | | | |
|---|---|---|---|---|---|
| D (microns) | $TiO_2$ | $SnO_2$ | ZnO | $Fe_3O_4$ | $ZrO_2SiO_2$ |
| 0.1 | 4 | 1 | 1 | 7 | 6 |
| 0.25 | 26 | 5 | 6 | 42 | 37 |
| 0.35 | 52 | 9 | 12 | 83 | 73 |
| 0.5 | 105 | 19 | 25 | 170 | 149 |
| 0.75 | 237 | 43 | 57 | 382 | 335 |
| 1 | 421 | 76 | 102 | 679 | 596 |

Those skilled in the art are capable, in light of the teachings herein and with a minimum of routine experimentation, of adjusting the laser fluence and pulse duration to accomplish the desired marking using a particular pigment without damaging the object substrate. Generally, the amount of energy applied to cause the desired marking should be minimized as much as possible consistent with accomplishing a good marking. The absorbed laser energy is generally dissipated by two means. Energy goes into inducing the color change, and into heating the surrounding object substrate by conduction. The conductive heating of the substrate of the object should be minimized as much as possible for two reasons. Heating of the substrate by thermal conduction should be minimized so that substantially all (at least about 80, and preferably 90 percent or more) of the applied energy goes to the marking process. Generally, any energy in excess of that required to accomplishing the desired marking goes to heat the object substrate, so the amount of applied energy should be minimized. The color change process generally proceeds much more rapidly than the conventional conductive heat transfer process. It is thus generally possible to complete the marking process before any significant conductive heat transfer takes place. If, for example, the pigment exhibits a high thermal conductivity, the laser pulse should be shortened to the point where marking is accomplished before any significant amount of energy flows into and heats the substrate.

The substrate of the object is generally a carbon or silicon based polymer. The term "polymer", as used herein is intended to include both carbon and silicon-based materials, and both natural and synthetic polymers. The present invention is generally applicable to such polymers. The energy absorption characteristics of such polymers are generally well known, or can be readily ascertained by routine experimentation. Generally, the marking occurs from the surface down for some depth into the substrate of the object. For clarity and ease of visibility, the substrate of the object is preferably at least slightly translucent so pigment particles that are located below the surface of the object contribute somewhat to the visibility and other characteristics of the visible marking.

The amount of energy flux required to effect the desired marking depends, for example, on the particle size and loading rate of the pigment, the pigment itself, and the energy absorbed by the pigment at the wavelength of the coherent energy.

Preferably, for high volume production requirements the laser should have a pulse rate of from at least about 10 to about 1000, preferably, 20 to 400 Hertz. Pulse rate is to be distinguished from pulse duration. These are different characteristics of any given laser. Pulse rate generally defines the maximum production rate. Pulse rate indicates how many times the ultraviolet laser fires in one second, which is usually described in number of events per second (Hertz). Pulse duration indicates how long the laser is illuminated during each pulse, and is described in nanoseconds. With such short pulse durations, the laser is dark (not illuminated) for most of the time. It is during these dark periods that the object moves from one marking position to the next, and the mirror elements are adjusted to change the pattern of radiation. Pulsed lasers deliver substantially more power, but only for short periods of time, as compared with continuous lasers. Continuous lasers are generally not satisfactory for marking purposes according to the present invention.

The energy absorption characteristics of commercially available molding and casting resins are well known, as are those of conventional non-pigment additives that are typically used in the compounding of such materials. The wavelength of the coherent energy should be tailored to meet the requirements of the object. If, for example, the object to be marked is destined for exterior usage where a conventional UV blocker must be included in the compounding of the molding resin, the wavelength of the marking coherent energy should preferably not be in the ultraviolet range. The flux density of the coherent marking energy should be tailored to the requirements of the DMD, the substrate material of which the object is made, the capacity of the system to reliably expand and condense the beam, and the marking material.

Coherent visible light can be used to generate non-destructive markings, if desired. The wavelength of the coherent (laser generated) energy is chosen so that the radiation sensitive material in the object substrate strongly absorbs the energy and the rest of the object, or at least the substrate where the pigment is found, does not. Heating and ablation of the object is likely to occur if anything other than the marking material strongly absorbs the coherent energy. The DMD will be damaged if it is not well protected from the strong pulses of coherent energy.

What have been described are preferred embodiments in which modifications and changes may be made without departing from the spirit and scope of the accompanying claims. Many modifications and variations of the present invention are possible in light of the above teachings. It is therefore to be understood that, within the scope of the appended claims, the invention may be practiced otherwise than as specifically described.

What is claimed is:

1. Method of non-destructively marking an object containing a radiation sensitive material with a detectable predefined pattern using laser generated radiation, said method comprising:

selecting said object, said object including an object substrate having a markingly effective amount of said radiation sensitive material in a region that is generally visible, said radiation sensitive material requiring minimum level of radiation flux to effect said marking;

selecting a digital micro-mirror device, said digital micro-mirror device having a mirrored face and being capable of tolerating a maximum level of radiation flux, said maximum level being less than said minimum level;

adjusting said mirrored face to reflect said detectable predefined pattern;

generating a pulse of radiation, said pulse of radiation being coherent and having a first cross-sectional area, the level of said radiation flux in said first cross-sectional area being greater than said maximum level;

expanding the cross-sectional area of said pulse of radiation to produce an expanded pulse of radiation, the level of said radiation flux in said expanded pulse of radiation being no greater than said maximum level;

impinging said expanded pulse of radiation on said mirrored surface and allowing said mirrored surface to reflect said expanded pulse of radiation in a patterned pulse of radiation;

condensing said patterned pulse of radiation to produce a condensed patterned pulse of radiation, the level of radiation flux in said condensed patterned pulse of radiation being at least as great as said minimum level; and projecting said condensed patterned pulse of radiation on said object substrate and allowing said detectable predefined pattern to form in said radiation sensitive material.

2. A method of claim 1 including selecting a said digital micro-mirror device that is capable of tolerating a maximum level of radiation flux that is less than approximately half said minimum level.

3. A method of claim 1 including serially generating at least a first and a second said pulse of radiation, and adjusting said mirrored face to reflect different detectable predefined patterns between said first and second pulses of radiation.

4. A method of claim 1 wherein said condensing includes adjusting said mirrored face to condense said patterned pulse of radiation.

5. A method of claim 1 including selecting a said radiation sensitive material that is adapted to absorbing at least 10 times more of said radiation than said object substrate.

6. Method of marking titanium dioxide containing object substrate with a detectable predefined pattern using coherent ultraviolet radiation, said method comprising:

generating a pulse of coherent ultraviolet radiation having a first footprint, said coherent ultraviolet radiation having a first flux density within said first footprint;

expanding said pulse of coherent ultraviolet radiation to a second footprint having a second flux density;

projecting said second footprint on a mirrored face of a digital micro-mirror device, and allowing said mirrored face to reflect said coherent ultraviolet radiation in said detectable predefined pattern to produce a reflected footprint;

condensing said reflected footprint to produce a marking footprint having a third flux density, said first and third flux densities being greater than said digital micro-mirror device is capable of withstanding, and said third flux density being at least sufficient to cause the color of said titanium dioxide to change, and less than a level at which visible damage occurs to said object substrate; and projecting said marking footprint on said object substrate and allowing said detectable predefined pattern to form in said titanium dioxide.

7. A method of claim 6 including selecting an object substrate that absorbs less than approximately one fifth as much of said coherent ultraviolet radiation as said titanium dioxide.

8. A method of claim 6 including condensing said reflected footprint so that said third flux density is greater than said first flux density.

9. Method of marking titanium dioxide containing object substrates with a detectable predefined pattern using coherent ultraviolet energy, said method comprising:

projecting a series of pulses of coherent ultraviolet energy having a first level of flux density onto a mirrored face of a digital micro-mirror device, said mirrored face being composed of a plurality of individual mirror elements, said individual mirror elements being individually controllable, tiltable, and spaced apart, a bypass portion of said coherent ultraviolet energy having said first level of flux density projecting between said individual mirror elements and impinging upon a base behind said individual mirror elements;

preventing said bypass portion from damaging or disrupting said base; and allowing said mirrored face to reflect said coherent ultraviolet energy in said detectable predefined patterns;

adjusting said mirrored face between at least some of said pulses and allowing said mirrored face to reflect said pulses of coherent ultraviolet energy in different ones of said detectable predefined patterns to produce a series of reflected footprints;

condensing said reflected footprints to produce a series of marking footprints having a second level of flux density, said second level of flux density being at least sufficient to cause said titanium dioxide to change color, and less than a level at which visible damage occurs to said object substrates;

preventing said bypass portion from being reflected within said marking footprints; and projecting said marking footprints on said object substrates and allowing said detectable predefined pattern to form in said titanium dioxide.

10. A method of marking according to claim 9 wherein said preventing includes reflecting at least a part of said bypass portion away from said base.

11. A method of marking according to claim 9 wherein said preventing includes absorbing at least a part of said bypass portion in said base.

12. A method of marking according to claim 9 wherein said preventing includes conducting at least a part of said bypass portion away from said base.

13. A method of marking according to claim 9 including selecting a said object substrate that is capable of absorbing less than approximately one fifth as much of said coherent ultraviolet energy as said titanium dioxide.

14. Method of making a plurality of markings with detectable predefined patterns on titanium dioxide containing object substrates using coherent ultraviolet energy, said method comprising:

projecting a series of pulses of coherent ultraviolet energy onto a mirrored face of a digital micro-mirror device, each of said pulses having a first level of flux density;

adjusting said mirrored face between at least some of said pulses and allowing said mirrored face to reflect said pulses of coherent ultraviolet energy in different ones of said detectable predefined patterns to produce a series of reflected footprints, said first level of flux density being less than a damaging level at which said digital micro-mirror device is damaged or disrupted;

condensing said reflected footprints to produce marking footprints having a second level of flux density, said second level of flux density being greater than said damaging level, at least sufficient to cause said titanium dioxide to change color, and less than a level at which visible damage occurs to said object substrates;

projecting said marking footprints on said object substrates and allowing said detectable predefined patterns to form in said titanium dioxide; and preventing said marking footprints from damaging said object substrates by selecting object substrates that are adapted to absorbing less than approximately one tenth as much of said coherent ultraviolet energy as said titanium dioxide.

15. Method of non-destructively marking object substrates containing a radiation sensitive material with detectable predefined patterns using coherent energy, said method comprising:

projecting a series of pulses of coherent energy having a first level of flux density onto a mirrored face of a digital micro-mirror device, said mirrored face being composed of a plurality of individual mirror elements, said individual mirror elements being individually controllable, tiltable, and spaced apart, a bypass portion of said coherent ultraviolet energy having said first level of flux density projecting between said individual mirror elements and impinging upon a mirror support base behind said individual mirror elements, said first level of flux density being less than a damaging level at which said support base is damaged or disrupted, and allowing said mirrored face to reflect said coherent energy in said detectable predefined patterns;

adjusting said mirrored face between at least some of said pulses and allowing said mirrored face to reflect said pulses of coherent energy in different ones of said detectable predefined patterns to produce a series of reflected footprints;

condensing said reflected footprints to produce a series of marking footprints having a second level of flux density, said second level of flux density being greater than said damaging level, at least sufficient to cause said radiation sensitive material to change color, and less than a level at which visible damage occurs to said object substrates;

preventing said bypass portion from being reflected into said marking footprints, and dissipating said bypass portion of said coherent energy from said mirror support base;

projecting said marking footprints on said object substrates and allowing said detectable predefined patterns to form in said radiation sensitive material; and preventing said marking footprints from damaging said object substrates by selecting object substrates that are adapted to absorbing less than approximately one tenth as much of said coherent ultraviolet energy as said radiation sensitive material.

16. Method of marking radiation sensitive material containing object substrate with a detectable predefined pattern using coherent radiation, said method comprising:

generating a pulse of coherent radiation having a first footprint, said coherent radiation having a first flux density within said first footprint;

expanding said pulse of coherent radiation to a second footprint having a second flux density;

projecting said second footprint on a mirrored face of a digital micro-mirror device, and allowing said mirrored face to reflect said coherent radiation in said detectable predefined pattern to produce a reflected footprint;

condensing said reflected footprint to produce a marking footprint having a third flux density, said first and third flux densities being greater than said digital micro-mirror device is capable of withstanding, and said third flux density being at least sufficient to cause the color of said radiation sensitive material to change, and less than a level at which visible damage occurs to said object substrate;

minimizing the level of said third flux density that is required to cause said color change; and projecting said marking footprint on said object substrate and allowing said detectable predefined pattern to form in said radiation sensitive material.

17. Method of marking of claim 16 wherein said minimizing includes utilizing from about 0.5 to about 5 weight percent of said radiation sensitive material in said object substrate.

18. Method of marking of claim 16 wherein said minimizing includes selecting a said radiation sensitive material having an average particle size of less than approximately 10 microns.

19. Method of marking of claim 16 wherein said minimizing includes selecting a said radiation sensitive material having an average particle size of less than approximately 5 microns, and utilizing from about 0.5 to about 2 weight percent of said radiation sensitive material in said object substrate.

20. Method of marking of claim 16 wherein said minimizing includes selecting titanium dioxide as said radiation sensitive material and coherent ultraviolet light as said coherent energy, said titanium dioxide having an average particle size of less than approximately 10 microns, and utilizing from about 0.5 to about 5 weight percent of said titanium dioxide in said object substrate.

* * * * *